United States Patent [19]

LaBate

[11] Patent Number: 4,858,894

[45] Date of Patent: Aug. 22, 1989

[54] STIRRING BLOCK WITH UNIDIRECTIONAL GRAIN STRUCTURE HAVING IMPROVED EROSION RESISTANCE

[76] Inventor: Micheal D. LaBate, 115 Hazen Ave., Ellwood City, Pa. 16117

[21] Appl. No.: 213,938

[22] Filed: Jun. 30, 1988

[51] Int. Cl.[4] ..... C21C 5/48

[52] U.S. Cl. ..... 266/265; 266/218

[58] Field of Search ..... 266/218, 220, 224, 266, 266/270, 283, 284, 265

[56] References Cited

U.S. PATENT DOCUMENTS

| | | | |
|---|---|---|---|
| 3,851,865 | 12/1974 | Fisher | 266/224 |
| 3,905,589 | 9/1975 | Schempp et al. | 266/224 |
| 4,396,179 | 8/1983 | LaBate | 266/220 |
| 4,483,520 | 11/1984 | LaBate | 266/220 |
| 4,538,795 | 9/1985 | LaBate | 266/220 |
| 4,568,066 | 2/1986 | Grabner et al. | 266/224 |
| 4,632,367 | 12/1986 | LaBate | 266/220 |
| 4,687,184 | 8/1987 | LaBate et al. | 266/270 |
| 4,725,047 | 2/1988 | LaBate | 266/270 |

FOREIGN PATENT DOCUMENTS

| | | | |
|---|---|---|---|
| 852318 | 10/1960 | United Kingdom | 266/224 |

*Primary Examiner*—Robert McDowell

*Attorney, Agent, or Firm*—Harpman & Harpman

[57] ABSTRACT

A device for introducing gas into a mass of molten metal in a vessel for creating a stirring action therein has a rammed or pressed apertured block of relatively great density and a grain structure perpendicular to the exposed working surface of the block, the apertures in the block being parallel with the grain structure and provide vertical passageways in which gas delivering tubes are positioned to communicate with the working surface of the block and the molten metal in the vessel. The formation of the block with its grain structure perpendicular to the working or exposed surface of the block greatly improves the life of the device by substantially reducing the erosion rate thereof.

3 Claims, 2 Drawing Sheets

STIRRING BLOCK WITH UNIDIRECTIONAL GRAIN STRUCTURE HAVING IMPROVED EROSION RESISTANCE

BACKGROUND OF THE INVENTION

1. Technical Field

This invention relates to devices for insufflating gas into a mass of molten metal wherein the device is positioned in the refractory lining of the bottom or wall of the vessel and gas is introduced into the vessel therethrough.

2. Description of the Prior Art

Prior structures have generally employed permeable plugs or solid plugs and spaced jackets thereabout positioned in apertured refractory pocket blocks. Usually frusto-conical apertures in the conventional pocket blocks received the frusto-conical plugs or solid frusto-conical plug and jacket combinations and all of the prior art devices have a relatively short life due to the erosion of the pocket block and the plugs or their equivalents incorporated therein.

Typical prior art devices may be seen in U.S. Pat. Nos. 4,396,179 to LaBate, 4,483,520 to LaBate, 4,538,795 to LaBate, 4,632,367 to LaBate, 4,687,184 to LaBate, et al., and 4,725,047 to LaBate.

The present invention comprises an improvement with respect to the devices disclosed in my above-mentioned U.S. Patents, all of which use conventionally formed pocket blocks.

The present invention discloses a stirring block for introducing gas into a mass of molten metal in a vessel wherein the actual block has a substantially greater density than pocket blocks heretofore known in the art, the greater density being achieved by pressure ramming of multiple layers of refractory material or alternately high pressure formation of pressed units of refractory material with the passageways in a block being formed during the ramming or pressing stages of formation so as to extend through the stirring block in the direction of the grain structure whereby the working or exposed surface of the stirring block presents an unusually dense surface having very great erosion resistance such as heretofore unknown in the art.

SUMMARY OF THE INVENTION

A stirring block with improved erosion resistance to molten metal is used for introducing gas into molten metal and is positioned in the lining of a vessel containing the molten metal in registry with an opening in the vessel so that gas such as argon can be directed therethrough. The stirring block is formed of unusually dense refractory material with the grain structure running from the upper or working surface thereof to the lower or innermost surface thereof and parallel with a plurality of passageways extending therethrough and formed therein during the formation of the stirring block. The improved stirring block is generally rectangular and has a cast in place safety housing across the bottom of the block and extending upwardly so as to partially enclose the lower side walls of the block. The stirring block with its cast in place safety housing in which gas conveying tubes are positioned during formation form a unit that is readily positioned in a vessel for molten metal in the usual refractory lining thereof and in communication with a gas supply pipe.

DESCRIPTION OF THE PREFERRED EMBODIMENT

Figure 1:
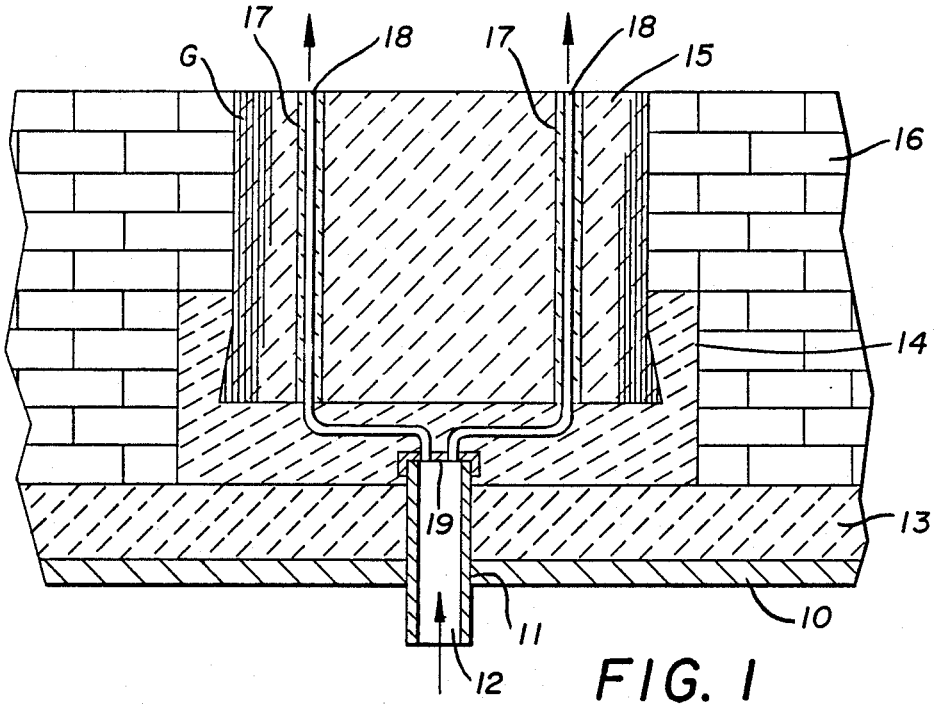
FIG. 1 is a vertical section through a vessel for molten metal showing the stirring block positioned in the refractory lining of the vessel.
Figure 2:
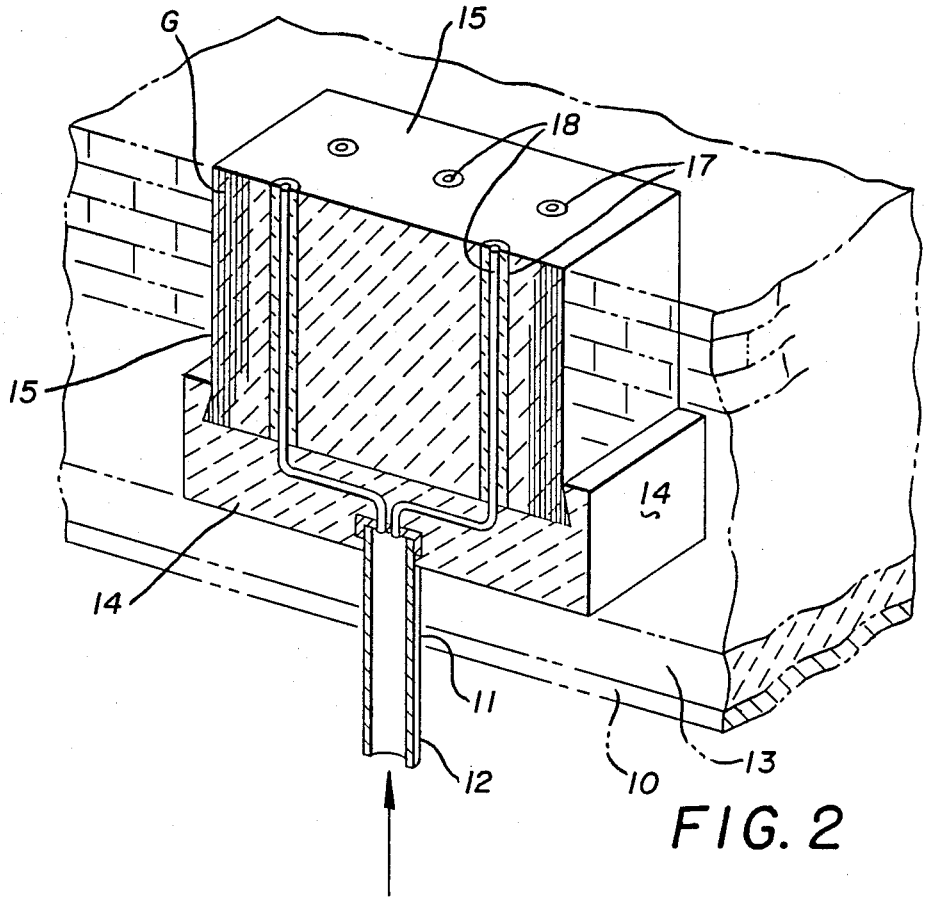
FIG. 2 is a perspective view of a portion of a vessel for molten metal and the refractory lining therein showing the stirring block in position therein.

In the form of the invention chosen for illustration herein the stirring block with improved erosion resistance for introducing gas into molten metal may be seen in assembled and installed position in FIGS. 1 and 2 of the drawings. By referring thereto, the bottom wall 10 of a vessel, such as a ladle, furnace, tundish or the like for containing molten metal, will be seen to be provided with an opening 11 through which a gas supply pipe 12 extends. The usual safety lining 13 formed of rammed refractory or the like is illustrated with the gas supply pipe 12 extending upwardly therethrough so as to communicate with a safety housing 14 which is integrally cast on a stirring block 15, both the safety housing 13 and stirring block 15 being formed of refractory material. The usual refractory lining 16 of the vessel is illustrated as surrounding the stirring block.

The stirring block 15 has a plurality of vertically positioned apertures 17 extending therethrough which are formed in the stirring block 15 as hereinafter described. Several shaped metal tubes 18 are positioned one in each of the apertures 17 and extend outwardly of the lower ends of the apertures and are cast in position in the safety housing 14 which underlies the stirring block 15 and extends upwardly in dove-tailed engagement with the lower portions thereof. High temperature mortar is positioned in the vertically positioned apertures 17 around each of the plurality of tubes 18 and is so positioned immediately prior to the casting of the safety housing 14 thereon as hereinafter described. Each of the metal tubes 18 communicate with an apertured cap 19 on the upper end of the gas supplying pipe 12 so that argon or another gas introduced into the pipe 12 under suitable pressure and in suitable volume will be directed upwardly through the stirring block and out of the upper ends of the tubes 18 into the molten metal in the vessel in which the device is installed to create a highly desirable stirring action. It will be understood that there are a plurality of the vertical positioned apertures 17 and the metal tubes 18 positioned therein and approximately one-half of the stirring block of the invention is illustrated in the prospective view comprising FIG. 2 of the drawings.

The stirring block hereinbefore described differs structurally from the prior art principally by reason of its novel formation.

Figure 3:
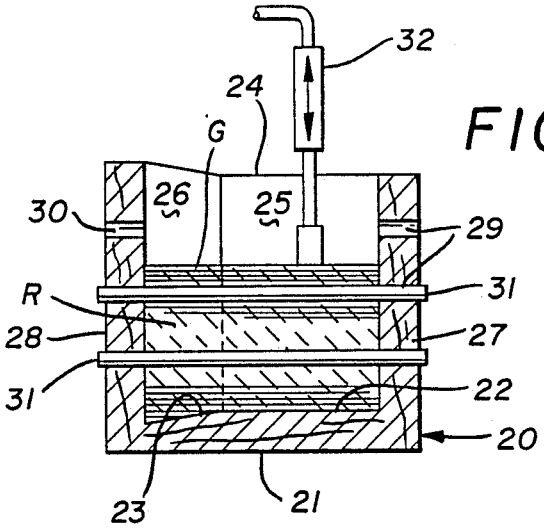
FIG. 3 is a vertical section through a ramming box with a ramming tool engaging refractory material therein, dowels are positioned transversely of the box.
Figure 4:
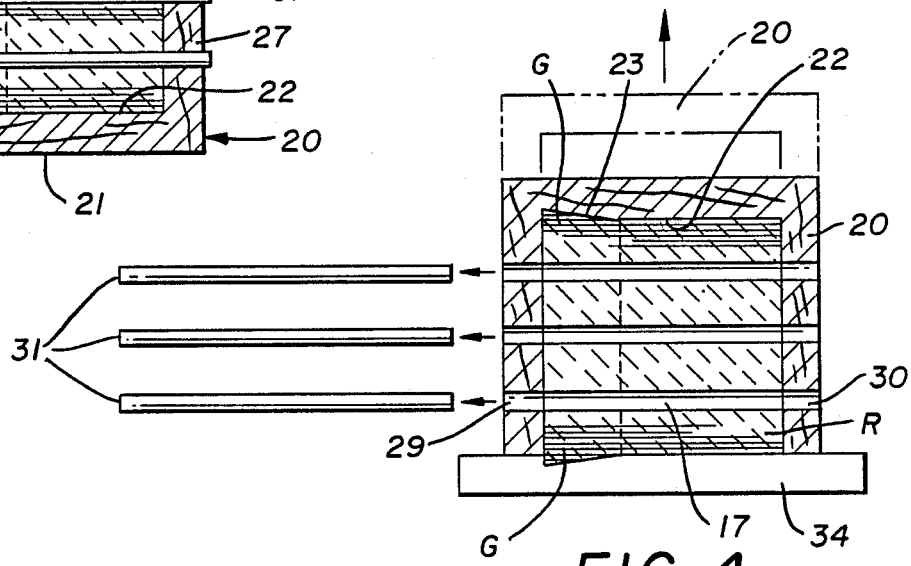
FIG. 4 is a vertical section through the ramming box of FIG. 3 showing the same inverted from the position shown in FIG. 3 and illustrating the removal of the dowels and broken lines illustrate the removal of the ramming box.
Figure 5:
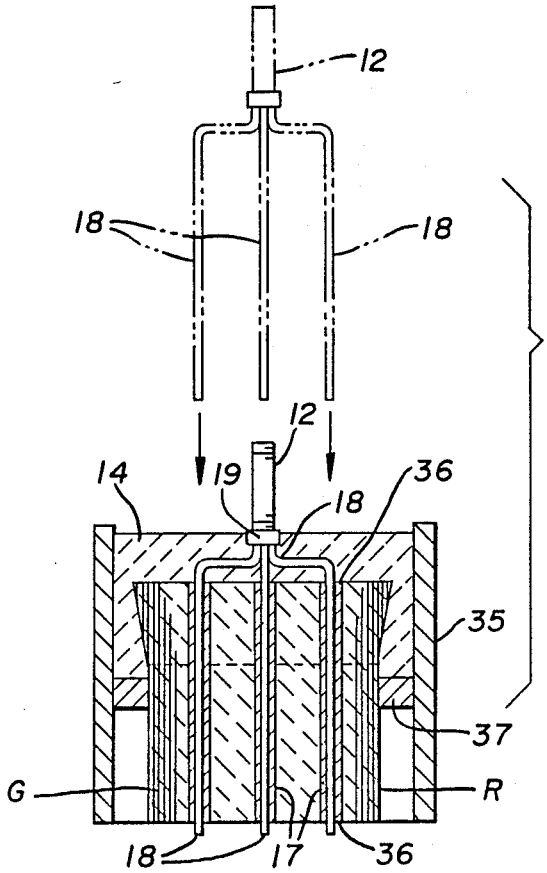
FIG. 5 is a vertical section of a casting form in which the stirring block is positioned in upside down relation and a safety housing being cast thereover in dove-tail engagmement and around and about an assembly of gas conveying tubes so as to form the stirring block of FIGS. 1 and 2.

By referring now to FIGS. 3, 4 and 5 of the drawings, the manner in which the stirring block 15 and its safety housing 14 are preferably formed may be seen. In FIG. 3 of the drawings, a ramming box 20 which may be formed of wood is illustrated in vertical section and it will be observed that the bottom 21 of the ramming box 20 has its inner surface defining a horizontal plane 22 and an angularly disposed plane 23. The back wall 24 has a vertical plane 25 and an extending angular vertical plane 26. The front wall of the ramming box 20 as seen in FIG. 3 is not illustrated due to the sectional view and it is formed as a mirror image of the back wall 24. The right side wall 27 has a uniform vertical plane as its inner surface as has the left side wall 28. The right and left side walls have a series of drilled openings 29 and 30 respectively therein in oppositely disposed relation for the reception of transversely extending dowels 31, two of which are illustrated. Refractory material R is shown positioned in the ramming box 20 and a ramming tool 32 is symbolically illustrated in position for imparting a heavy ramming action to the refractory material R. It will be understood that initially the material positioned on the bottom planes 22 and 23 of the ramming box 20 will be rammed by the tool 32 into a compact mass, the grain structure G which due to the ramming action under high pressure will run horizontally between the right and left side walls 27 and 28 respectively. As the material reaches the lowermost drilled openings 29 and 30, the dowels are inserted in the lowermost positions of the openings and the ramming then continues until the level of the intermediate dowel receiving openings 29 and 30 is reached whereupon the intermediate dowels 31 are positioned and the ramming continues as illustrated in FIG. 3 of the drawings, it being observed that the rammed material providing the desirable disposed grain structure G has not yet reached the uppermost drilled openings 29 and 30. The filling of the refractory material R and the ramming action continues until the ramming box 20 is completely filled and the upper surface of the rammed material corresponds with the planes of the upper edges of the block wall 24 and its oppositely disposed front wall, not shown. The resultant rammed or pressed block thus forms the stirring block 15 as illustrated in FIGS. 1 and 2 of the drawings and hereinbefore described with the grain structure G in a desired direction.

By referring now to FIG. 4 of the drawings, the ramming box 20 will be seen to have been inverted with respect to its positioning in FIG. 3 of the drawings so that its bottom planes 22 and 23 respectively are now uppermost and the rammed block still designated by the letter R is supported on a base plate 34, the upper surface of which conforms with the shape of the upper edges of the front and back walls of the ramming box 20 as hereinbefore described.

In the position illustrated in solid lines in FIG. 4, the dowels 31 may be removed from the openings 29 and 30 leaving the apertures 17, which are present in the finished stirring block 15. Broken lines in FIG. 4 also illustrate the removal of the ramming box 20 upwardly and away from the formed stirring block still designated by the letter R.

By referring now to FIG. 5 of the drawings, it will be seen that the formed stirring block R has been rotated a quarter turn clockwise from the position shown in FIG. 4 and positioned in a casting form 35 so that the apertures 17 now extend vertically. In such position, the apertures 17 can now receive the pluality of shaped tubes 18 which communicate with the apertured fitting 19 and the gas supply pipe 12, all as hereinbefore described in connection with FIGS. 1 and 2 of the drawings.

Still referring to FIG. 5, it will be seen that the shaped tubes 18 are illustrated in the upper part of the Figure in broken lines with arrows indicating that they can be moved downwardly into the apertures 17. When this occurs, high temperature mortar 27 is filled in the apertures 17 around the tubes 18 and castable refractory is positioned in the casting form 35 so as to surround the stirring block R above bars 37 to enclose the sides of the stirring block R and cover the top thereof to form the complete safety housing 14 as hereinbefore described and illustrated in FIGS. 1 and 2 of the drawings. The stirring block R with its safety housing 14 cast thereabout is now removed from the casting form 35 and baked to insure the removal of moisture therefrom. The device is then inverted to the position shown in FIGS. 1 and 2 of the drawings and may then be installed in a vessel in the refractory lining thereof, all as hereinbefore described.

Those skilled in the art will observe that the method of forming the stirring block 15 produces a refractory unit of very great density which may be completely controlled by the force exerted during the ramming or pressing operation used in its formation and most importantly applied to the refractory material so that the grain structure is perpendicular to the working or exposed surface, the uppermost surface of the stirring block 15 as seen in FIGS. 1 and 2 of the drawings and hereinbefore described.

Those skilled in the art will observe that the rammed or pressed unit in the cast safety housing results in a refractory stirring unit that has a highly desirable predetermined controllable erosion rate or standard which results in a greatly extended life cycle.

Those skilled in the art will observe that the rammed or pressed desirably grained stirring block unit may be inserted into a cast lance where it will function equally well in resisting erosion from the molten metal in which the lance is immersed.

The shaped metal tubes 18 may be cross sectionally round, oval or flattened to form means controlling the volume and/or direction of gas so as to provide a predetermined desired volume and rate of flow of gas into the molten metal and the resulting desired stirring.

It will thus be seen that a very substantially improved controlled stirring block and a method of making the same has been disclosed and having thus described my inventions,

What I claim is:

1. In a device for introducing stirring gas into a mass of molten metal in a vessel having a refractory lining and a stirring block having upper and lower surfaces positioned in said lining, the improvement comprising forming said stirring block of a refractory having a dense, unidirectional grain structure extending between said upper and lower surfaces, said upper surface positioned for engagement with said molten metal, apertures in said stirring block extending between said upper and lower surfaces, shaped tubes positioned in said apertures and a gas supply pipe positioned in an opening in said vessel and said lining and communicating with said shaped tubes.

2. The device for introducing stirring gas into a mass of molten metal set forth in claim 1 wherein a safety housing is positioned between said stirring block and said refractory lining.

3. The device for introducing stirring gas into a mass of molten metal set forth in claim 1 wherein a safety housing is positioned between said stirring block and said refractory lining and wherein the stirring block has a dove-tailed portion engaged in said safety housing to form a joined structure and wherein said shaped tubes extend through said safety housing to said gas pipe.

* * * * *